US006341511B1

(12) United States Patent
Snoke et al.

(10) Patent No.: US 6,341,511 B1
(45) **Date of Patent: *Jan. 29, 2002**

(54) WORKSTATION LOCK SYSTEM

(75) Inventors: Steven R. Snoke, Batavia; James D. Stewart, Hamilton; George Funari, Washington Court House; Gary Silvis, Georgetown, all of OH (US)

(73) Assignee: Stanley Mechanics Tools, Inc., Carrollton, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/974,721

(22) Filed: Nov. 19, 1997

(51) Int. Cl.[7] ..... E05B 65/46

(52) U.S. Cl. ..... 70/85; 70/78; 312/219; 312/218

(58) Field of Search ..... 70/75–86; 312/219, 312/218, 216, 217; 109/45, 49, 56, 53, 59 R

(56) References Cited

U.S. PATENT DOCUMENTS

| | | | | | |
|---|---|---|---|---|---|
| 683,835 | A | * | 10/1901 | Beckwith | 70/85 |
| 1,806,643 | A | * | 5/1931 | Ohnstrand | 70/84 |
| 2,729,088 | A | * | 1/1956 | Huot et al. | 70/82 |
| 2,835,547 | A | * | 5/1958 | Erismann | 312/219 |
| 3,175,872 | A | * | 3/1965 | Sullivan | 312/219 |
| 3,664,720 | A | * | 5/1972 | Thomas | 312/219 |
| 3,976,343 | A | * | 8/1976 | Breckner et al. | 70/85 |
| 4,057,306 | A | * | 11/1977 | Resch, Jr. | 312/218 |
| 4,099,397 | A | * | 7/1978 | Dauenbaugh | 70/371 |
| 4,609,233 | A | * | 9/1986 | Walla | 312/219 |
| 5,257,860 | A | * | 11/1993 | Slivon | 70/78 |
| 5,351,512 | A | * | 10/1994 | Pearlman | 70/279.1 |

FOREIGN PATENT DOCUMENTS

| | | | | |
|---|---|---|---|---|
| AT | 203662 | * | 3/1956 | 212/219 |
| GB | 626307 | * | 7/1949 | 70/86 |
| GB | 844462 | * | 8/1960 | 70/85 |

* cited by examiner

*Primary Examiner*—Darnell Jayne
(74) *Attorney, Agent, or Firm*—Pillsbury Winthrop LLP Intellectual Property

(57) ABSTRACT

A lock system for locking a chest having multiple banks of drawers having a horizontally situated transfer mechanism, the transfer mechanism adapted to move horizontally and where the transfer mechanism is positioned behind a portion of each of the multiple banks of drawers intended to be locked and unlocked; a lockrod for actuating the horizontally situated transfer mechanism; and a plurality of vertically situated lock hinges, where each of the lock hinges corresponding to a bank of drawers, and wherein each of the vertically situated lock hinges are actuated by a horizontal movement of the transfer mechanism.

3 Claims, 12 Drawing Sheets

NO UPRIGHTS

ONE TALL UPRIGHT -LEFT

ONE TALL UPRIGHT -RIGHT

ONE SHORT UPRIGHT -LEFT

ONE SHORT UPRIGHT -RIGHT

TWO TALL UPRIGHTS

THREE TALL UPRIGHTS

TWO SHORT UPRIGHTS

THREE SHORT UPRIGHTS

TALL UPRIGHT LEFT SHORT UPRIGHT-RIGHT

TALL UPRIGHT-RIGHT SHORT UPRIGHT-LEFT

TALL UPRIGHT LEFT AND CENTER; SHORT UPRIGHT-RIGHT

TALL UPRIGHT RIGHT AND CENTER; SHORT UPRIGHT -LEFT

TALL UPRIGHT LEFT AND RIGHT; SHORT UPRIGHT -CENTER

SHORT UPRIGHT LEFT AND CENTER; TALL UPRIGHT-RIGHT

SHORT UPRIGHT RIGHT AND CENTER; TALL UPRIGHT-LEFT

SHORT UPRIGHT LEFT AND RIGHT; TALL UPRIGHT -CENTER

WORKSTATION LOCK SYSTEM

BACKGROUND AND SUMMARY OF THE INVENTION

The present invention relates to the field of workstations, and more particularly, to an improved workstation lock system.

Portable tool chests are known in the art (e.g. U.S. Pat. Nos. 5,549,377 and 4,938,548). However, known tool chests, or workstations, have traditionally been installed with lock systems that are hard to service, require high actuation force, and are not easily installed in workstations of different sizes. The demand for, and cost of, heavy-duty workstations is on the rise. Accordingly, the present invention provides a flexible lock system that may be used in many different types of workstations and with workstations of many sizes. The flexibility of the lock system of the present invention allows easy and costeffective integration in different types of workstations, with workstations of many sizes, and with workstations having various drawer arrangements.

The lock system of the present system is designed so as to allow low torque manipulation. The transfer channel of the present invention moves in the horizontal plane to lock and unlock banks of drawers. This horizontal actuation requires much less torque in manipulating the lock system as compared to traditional lock systems which operate in the vertical plane. The horizontally actuated transfer channel makes the lock system comfortable for the user to activate.

The lock system of the present invention is also designed to be easily serviced. As key locks are routinely serviced for code changes, the lock system of the present invention is designed with a "hairpin" clip underneath the key lock which provides easy access to the lock system. The lock system of the present invention may also be configured with a remote entry locking mechanism.

Accordingly, the present invention provides many advantages over known lock systems. The lock system of the present invention:

1.) is designed to allow easy locking and unlocking of multiple banks of drawers using a single keylock;

2.) allows manipulation of the lock mechanism by minimal torque making it very comfortable for the user to activate;

3.) is easily adapted to virtually any unit size or drawer configuration;

4.) is adapted with a keyless entry feature; and

5.) is adapted with a "key-alike" lock system that is easily changed without disassembling the entire unit.

The present invention is preferably comprised of:

a horizontally situated transfer mechanism, the transfer mechanism adapted to move horizontally; a means for actuating the horizontally situated transfer mechanism; and a plurality of vertically situated lock mechanisms, where each of the lock mechanisms corresponds to a bank of drawers, and wherein each of the vertically situated lock mechanisms are actuated by a horizontal movement of the transfer mechanism.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAILED DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
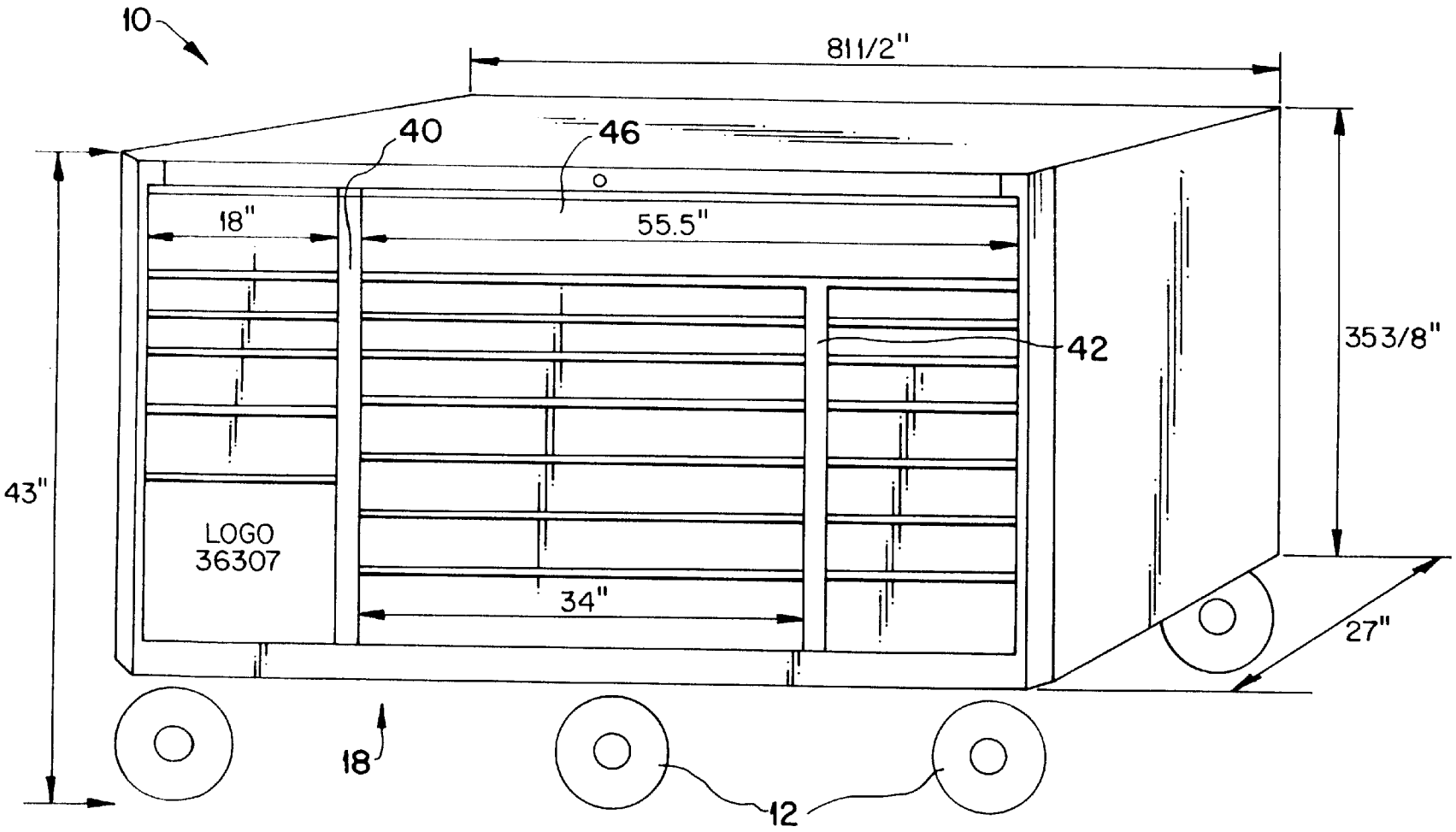
FIG. 1 illustrates one embodiment of an assembled workstation.

FIG. 1 illustrates one embodiment of an assembled workstation 10 to whicb the lock system of the present invention may be installed (although the following description relates to a lock system of the present invention installed on a modular workstation, it should be appreciated that the lock system may also be used with a one-piece workstation). The workstation 10 illustrated in FIG. 1 is a heavy-duty workstation capable of storing large loads and having the flexibility to be custom built for different user specifications.

In the preferred embodiment, the workstation 10 resides on spring casters 12. The casters 12 provide portability to the workstation 10. The casters 12 are designed to support the large loads the workstation 10 is capable of storing.

The workstation 10 illustrated in FIG. 1 depicts a workstation 10 having a first and second upright 40, 42 positioned in predetermined positions along the base portion 18 of the workstation 10. As will be discussed in greater detail below, the uprights 40, 42 may be placed in various locations along the base portion 18 to allow for different drawer arrangements. A third upright (not shown in FIG. 1, see FIGS. 5A–5Q) may also be used in conjunction with the first and second uprights 40, 42 to provide four banks of drawers across the workstation 10.

Example dime ions have been indicated on FIG. 1. In another embodiment of the workstation 10 shown it FIG. 1, the width of the workstation 10 is 88¼", the height of the unit is 38½" (46⅜" including the casters 12), and the depth of the unit is 27". In this embodiment, the width of the top large drawer is 60 9/16" and the width of the middle bank of drawers is 38 15/16".

Figure 2:
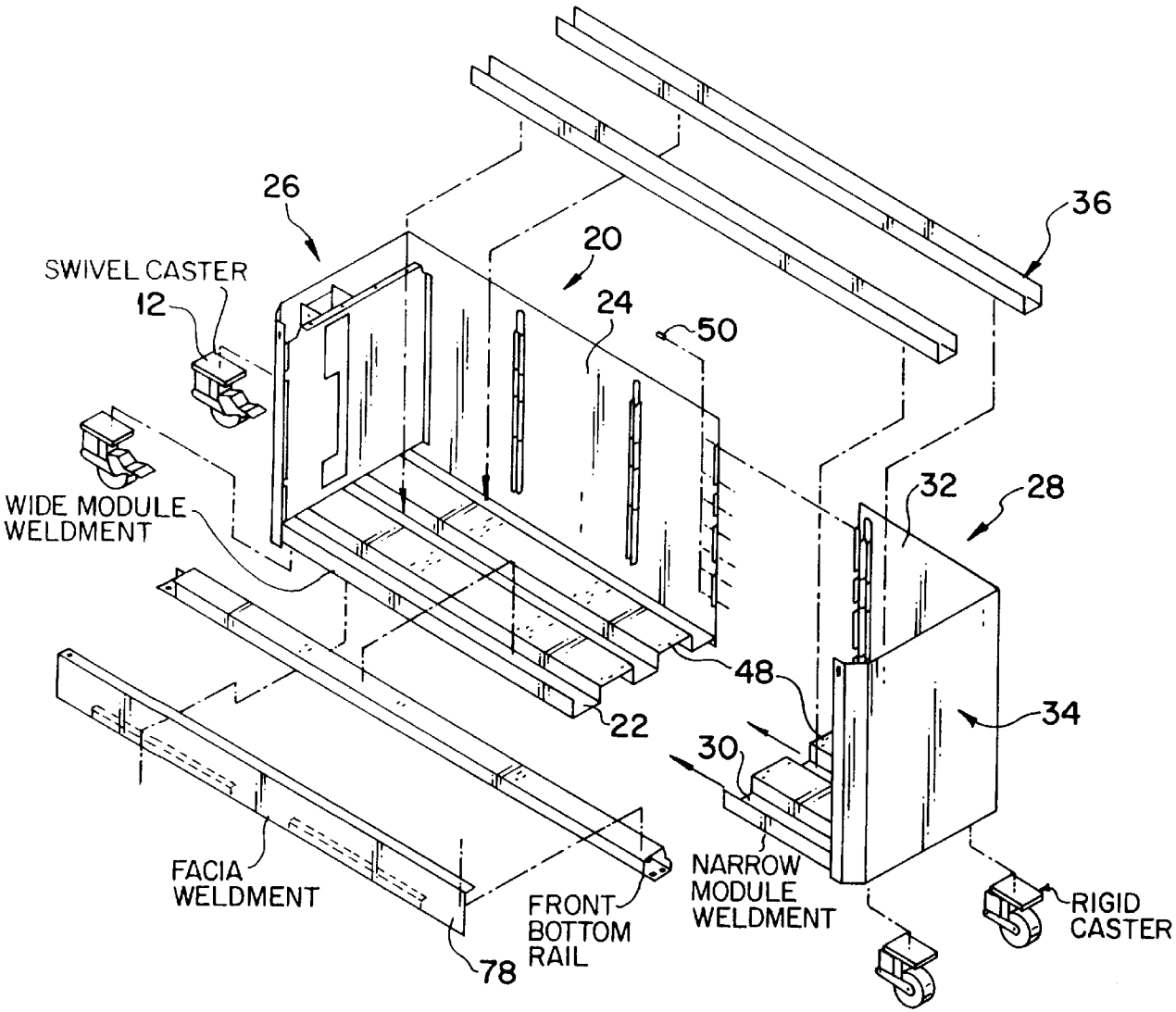
FIG. 2 illustrates an exploded view of one embodiment of a workstation.
Figure 3:
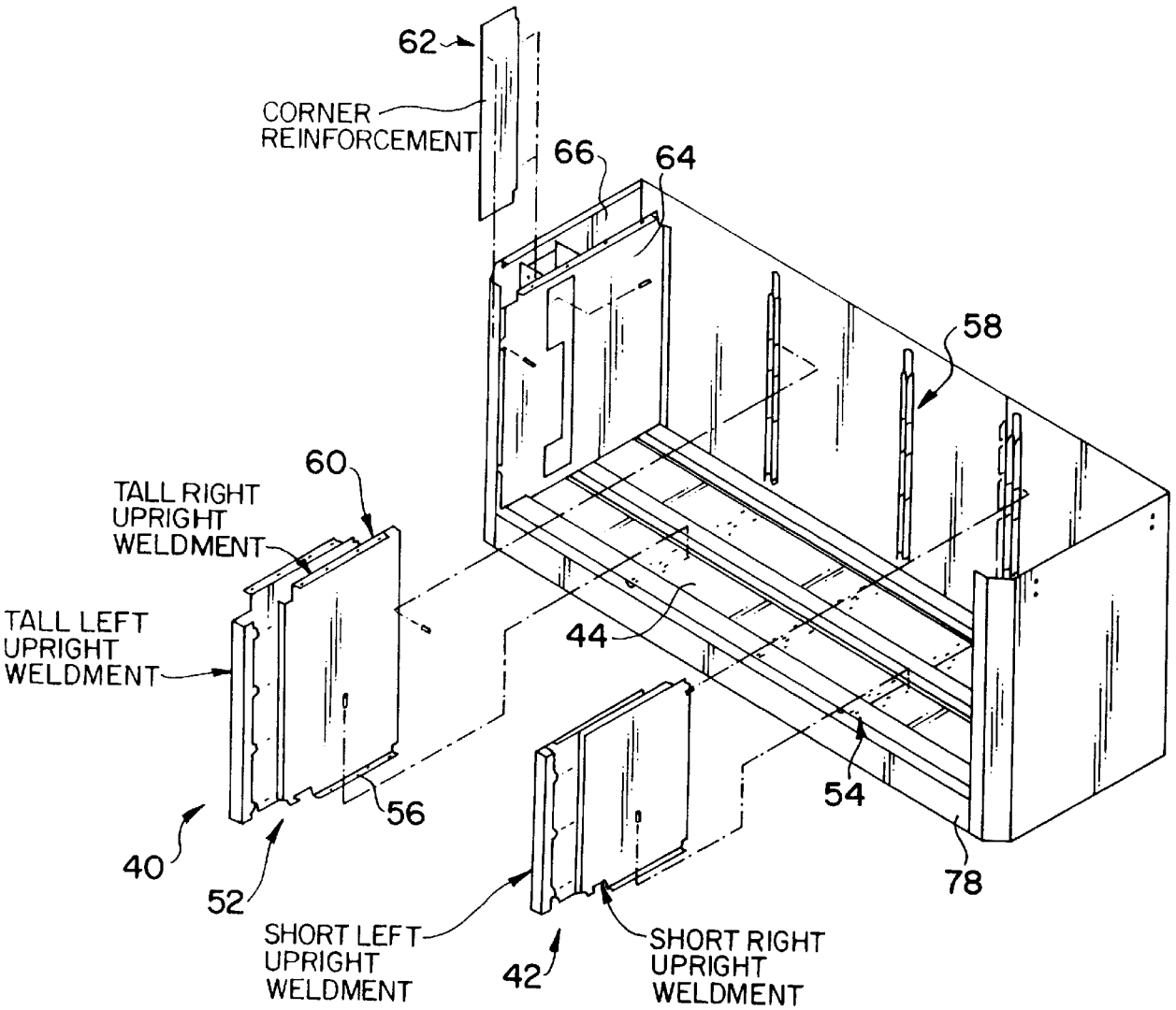
FIG. 3 illustrates one embodiment of a workstation with exploded views of the uprights.
Figure 4:
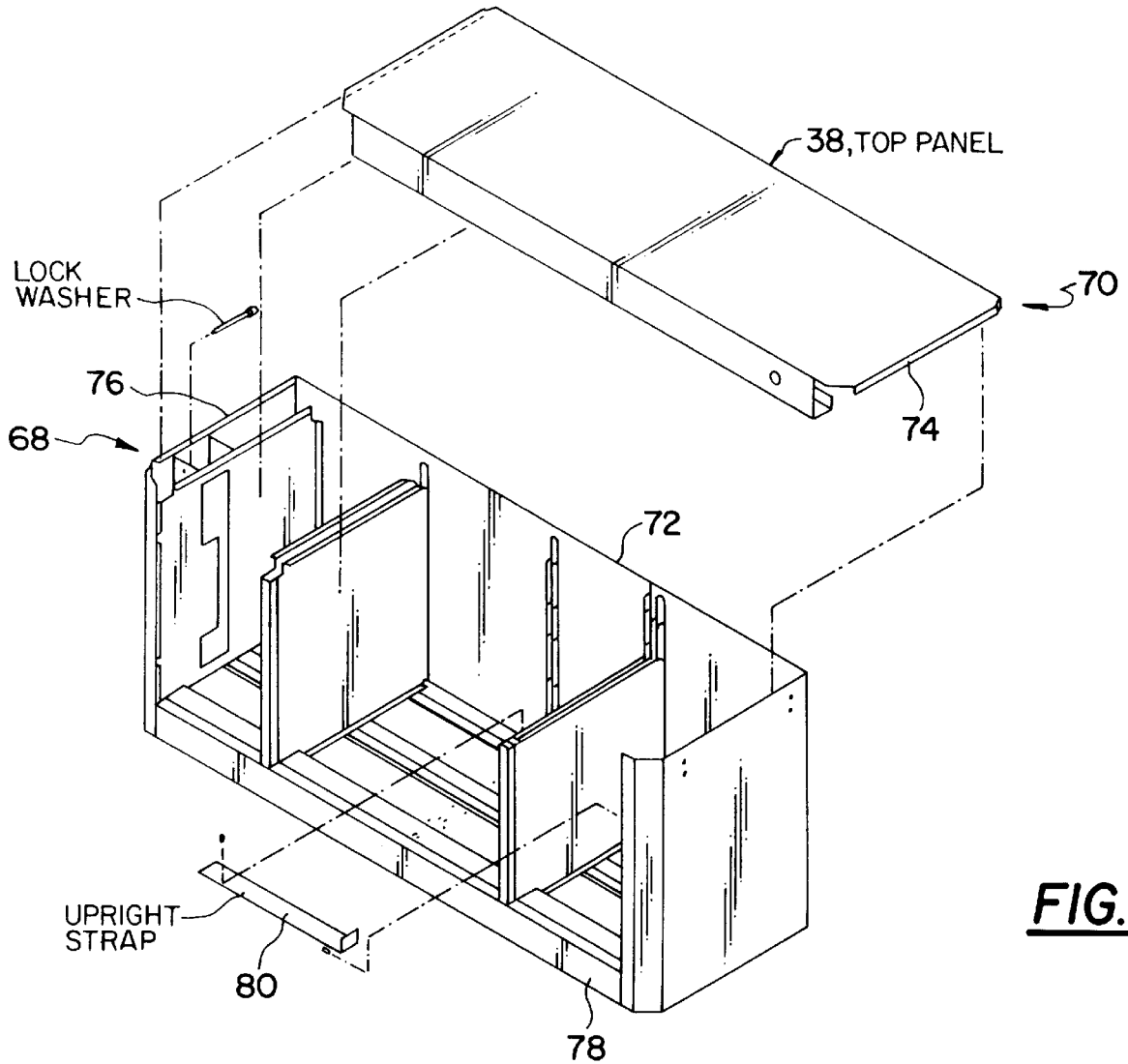
FIG. 4 illustrates one embodiment of a workstation with an exploded view of the top panel.

FIG. 2 illustrates an exploded view of the workstation 10. FIG. 3 illustrates one embodiment of the workstation 10 with exploded views of the uprights 40, 42 (the uprights 40, 42 may be of a one-piece or a multiple piece construction). FIG. 4 illustrates one embodiment of the workstation 10 with an exploded view of the top panel 38. In one embodiment, the workstation 10 is comprised of:

a.) a first module element 20 having a plurality of grooves 22, a back panel 24, a side panel portion 26, and a base;

b.) a second module element 28 having a plurality of grooves 30 corresponding to the grooves 22 of the first module element 20, a back panel 32, and a side panel portion 34, and a base;

c.) a plurality of rails 36 inserted into the plurality of grooves 22, 30 of the first and second module elements 20, 28;

d.) a top panel 38 secured to the back panels 24, 32 and side panel portions 26, 34 of the first and second module elements 20, 28;

e.) first and second uprights 40, 42 attached to a base portion 44 formed by the connected first and second module elements 20, 28;

f.) a plurality of drawers 46; and g.) means for holding the plurality of drawers 46 attached in predetermined positions on the uprights 40, 42 and side panel portions 26, 34 of the first and second module elements 20, 28.

In an alternative embodiment, the first and second module elements 20, 28 may be integrated into a one-piece construction. In such an embodiment the base portion 44 and the back panels 20, 32 would be of a one-piece construction.

In the preferred embodiment, the first module element 20 is wider than the second module element 28. The corresponding edges 48 of the first and second module elements 20, 28 are secured together. The back panels 24, 32 of the first and second module elements 20, 28 are preferably attached using 3/16" poprivets 50. The resulting joint may be concealed using an adhesive backed black bumper molding. FIG. 3 illustrates the first and second module elements 20, 28 in an assembled state.

In the preferred embodiment, once the first and second module elements 20, 28 are attached, a plurality of rails 36 may be placed into the grooves 22, 30. Each rail 36 preferably contains multiple threaded holes for receiving bolts. These bolts secure the module elements 20, 28 to the rails 36 and also provide mounting points for the swivel and rigid casters 12. The rails 36 provide the necessary stiffness to the workstation 10 to ensure the workstation will not sag under heavy loads (i.e. from the drawers, top chest or side cabinqts). The number of rails 36 placed in the workstation may vary depending on the width of the workstation 10 and the maximum load capacity. In the preferred embodiment, the workstation has three rails 36.

Figure 5A:
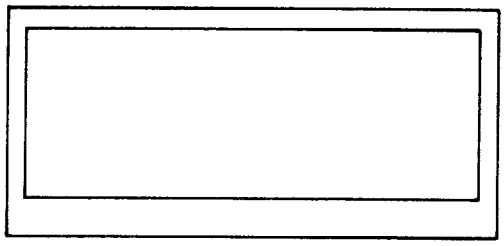
FIG. 5 illustrate alternative upright and drawer configurations of the workstation of FIGS. 1–4.
Figure 5B:
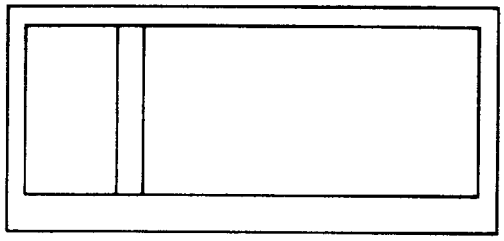
Figure 5C:
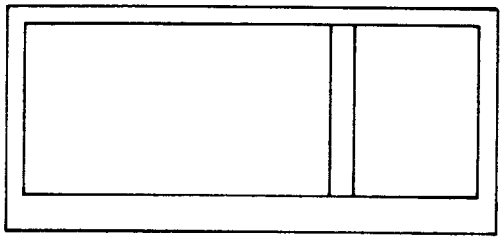
Figure 5D:
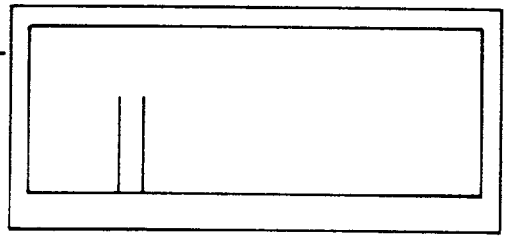
Figure 5E:
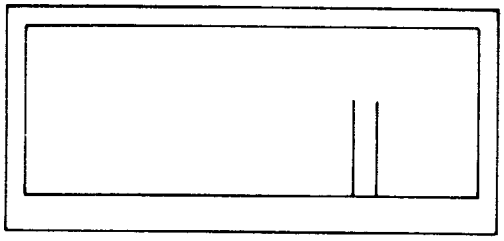
Figure 5F:
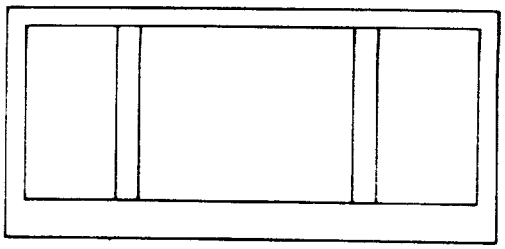
Figure 5G:
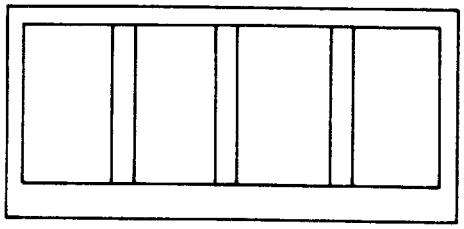
Figure 5H:
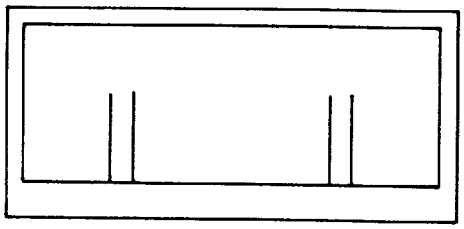
Figure 5I:
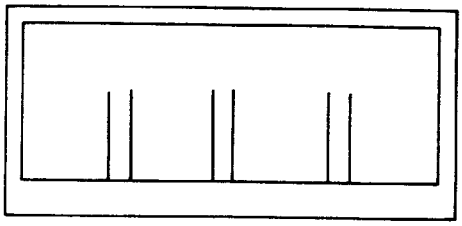
Figure 5J:
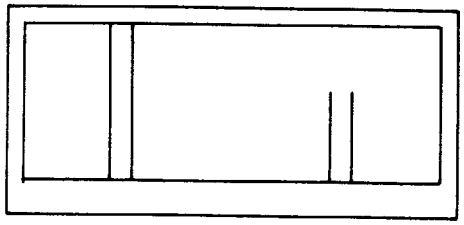
Figure 5K:
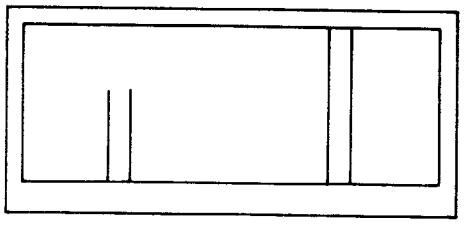
Figure 5L:
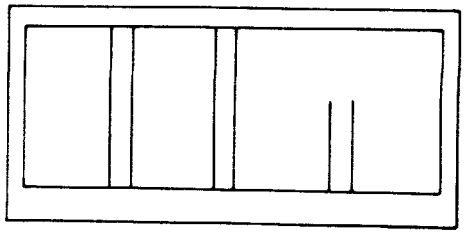
Figure 5M:
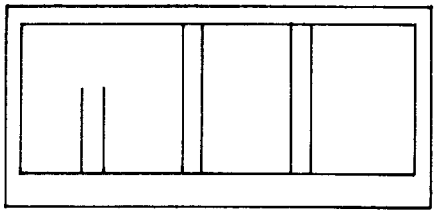
Figure 5N:
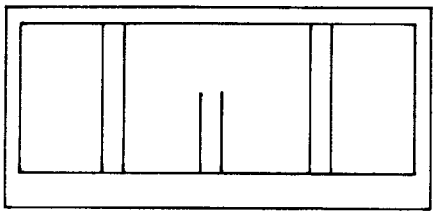
Figure 5O:
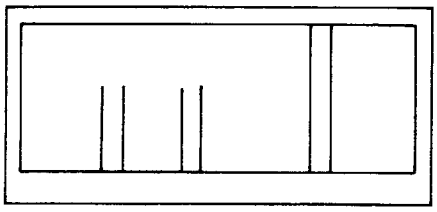
Figure 5P:
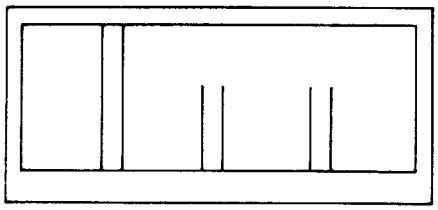
Figure 5Q:
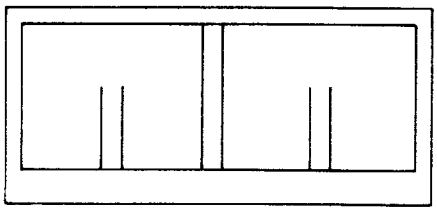

The uprights 40, 42 may be placed into the base portion 44 by inserting the bottom tabs 52 of the uprights 40, 42 into the slots 54 in the base portion 44 of the workstation 10. These uprights 40, 42 are also secured to the base portion 44 using screws along the bottom flanges 56 of the uprights 40, 42, the back flanges 58 of the back panel, and top flanges 60 located on the uprights 40, 42. The uprights 40, 42 may be "tall" uprights which extend all the way to the top panel 38 of the workstation 10 or they may be "short" uprights which do not extend to the top panel 38 of the workstation 10. The short uprights allow for the use of wider drawers 46. As discussed, in the preferred embodiment, either none, one, two, or three uprights may be used to accomplish various drawer configurations. FIGS. 5A–5Q illustrate elevational cross-sectional views of the workstation 10 of the preferred embodiment depicting various drawer configuration options of the workstation 10.

In the preferred embodiment, it is preferred that the side panel portions 26, 34 be constructed of a double-wall construction. As illustrated in FIG. 3, a double-wall side panel 26, 34 is comprised of an inner and outer wall 64, 66.

For high load bearing applications, it is preferred that a corner reinforcer 62 be inserted into the space formed by the inner and outer walls 64, 66 of the side panels 26,34. The corner reinforcement 62 is preferably held in position using sheet metal screws. The corner reinforcements 62 are vertical compression members that span from the top panel 38 to the base portion 44 of the workstation. The corner reinforcements 62 act to transfer top panel loads directly to the casters 12.

Referring to FIG. 4, in the preferred embodiment, bolts are inserted through clearance holes in the inner panel hat section 68 and hand threaded into a weld nut on the back side of the outer walls 66 (see areas identified as "A"). Subsequently, the top panel 38 may be secured to the workstation 10. It is preferred that the back edge of the top panel 38 contains an open hem flange 70 which hooks over the top edge 72 of the back panels 24, 32 of the first and second module elements 20, 28. The top panel 38 also preferably has side flanges 74 which are formed down and engage into wide pockets 76 running the depth of the outer wall 66. The overlapping of the top panel 38 and the outer wall 66, identified as Area "A", is clamped together by wrench tightening the bolts already in place in the clearance holes in the inner panel hat section 68. The resulting joint appears as a spot welded corner with no visible gap between the top panel 38 and the outer wall 66.

In the preferred embodiment, a facia strip 78 is secured to a front face of the base portion 44 of workstation 10, preferably using sheet metal screws. The facia strip 78 conceals the joint between the first and second module elements 20, 28 and also provides a skirt around the caster plate and mounting bolts.

The workstation 10 is preferably constructed from a durable steel material. The top panel 38 is preferably a high strength panel able to accommodate large loads without lock system failure (i.e. 500 lb. minimum). In an alternative embodiment, a work surface, such as a laminated board may be placed on the top of the workstation 10.

Figure 6:
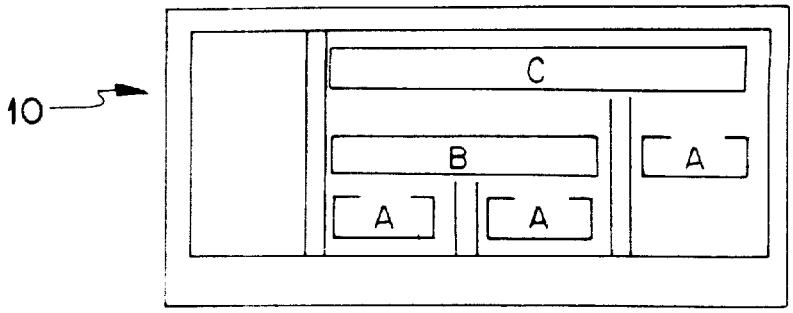
FIG. 6 illustrates an elevational cross-sectional view of the workstation of FIGS. 1–4.

The method of construction of the workstation 10 provides modularity and drawer interchangeability. The uprights may be reversed, doubled-up, or eliminated to create many different drawer configurations. FIGS. 5A–5Q illustrate some of the possible drawer configurations. Depending on the upright configuration used, different width drawers can be mounted adjacent to each other. For example, looking at FIG. 6, two narrow width drawers (denoted as A) may be removed and replaced with a wider drawer (denoted as B). Three narrow or one narrow and one wide drawer may be removed and replaced with an extra wide drawer (denote as C).

Additionally, different width cabinet modules can be joined together to create unique workstation dimensions and drawer arrangements. For example, two wide module elements may be assembled to create a wider unit. The width of the modules are generally controlled by the dimension of the smallest standard width drawer for a given application.

The workstation described above provides the strategic value of custom drawer configurations within a given workstation size. Also, the method of construction, and the modularity of the workstation, offers the capability for infinite workstation sizes. Additionally, by building the modules separately, larger workstation widths are no longer limited by the dimensional capability of the paint and fabrication equipment. Workstations may be produced to larger sizes without demanding capital investments for new painting and sheet metal equipment adapted to larger one-piece welded units.

Figure 7:
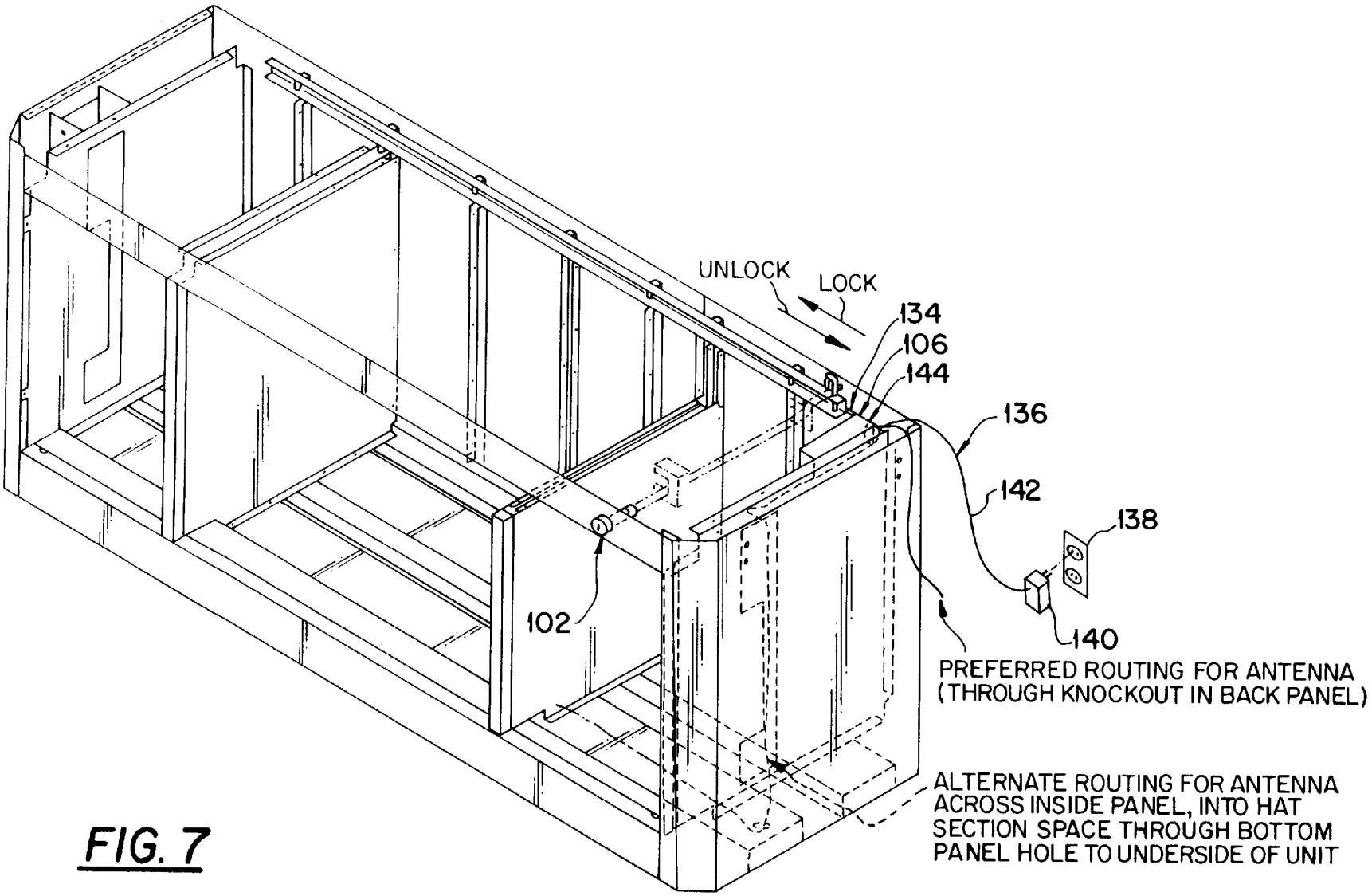
FIG. 7 illustrates a perspective view of one embodiment of the lock system of the present invention.

FIG. 7 illustrates a perspective view of the lock system 100 of the present invention installed on the modular workstation 10 described above. (It is again emphasized that the lock system 100 of the present invention may be used with the modular workstation 10 described above, or with various other workstations, including, but not limited to, a one-piece workstation.) The drawer locking system 100 of the present invention is designed to easily lock and unlock multiple banks of drawers using a single key lock 102. The key lock 102 may easily be serviced based on a "hairpin" clip 104 design. The horizontal actuation of the lock system 100 of the present invention requires minimal torque at the key (e.g. less than 5 in.lbs.) making it very comfortable for the user to activate. Unlike traditional vertical lifting lock systems, the rotary action lock system activates with horizontal movement. As a result, during activation, the system of the present invention does not operate against the force of gravity. Based on this low torque activation, a low power remote entry module 106 may be used to activate the lock system 100.

Figure 8:
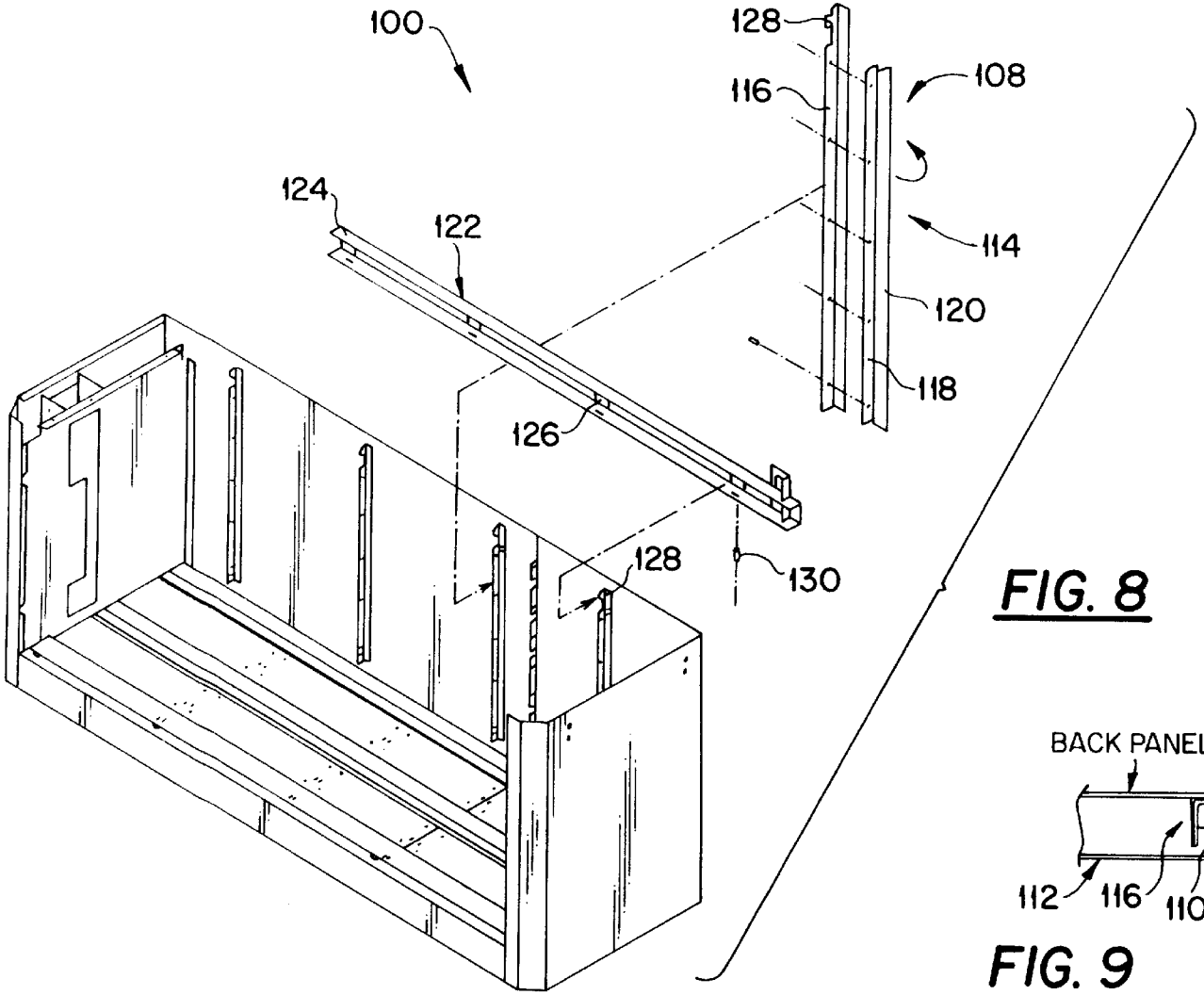
FIG. 8 illustrates an exploded view of portions of the lock system of the present invention.
Figure 9:
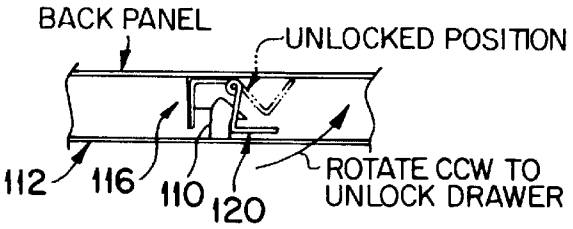
FIG. 9 illustrates embodiment of a drawer interface of the present invention.
Figure 12:
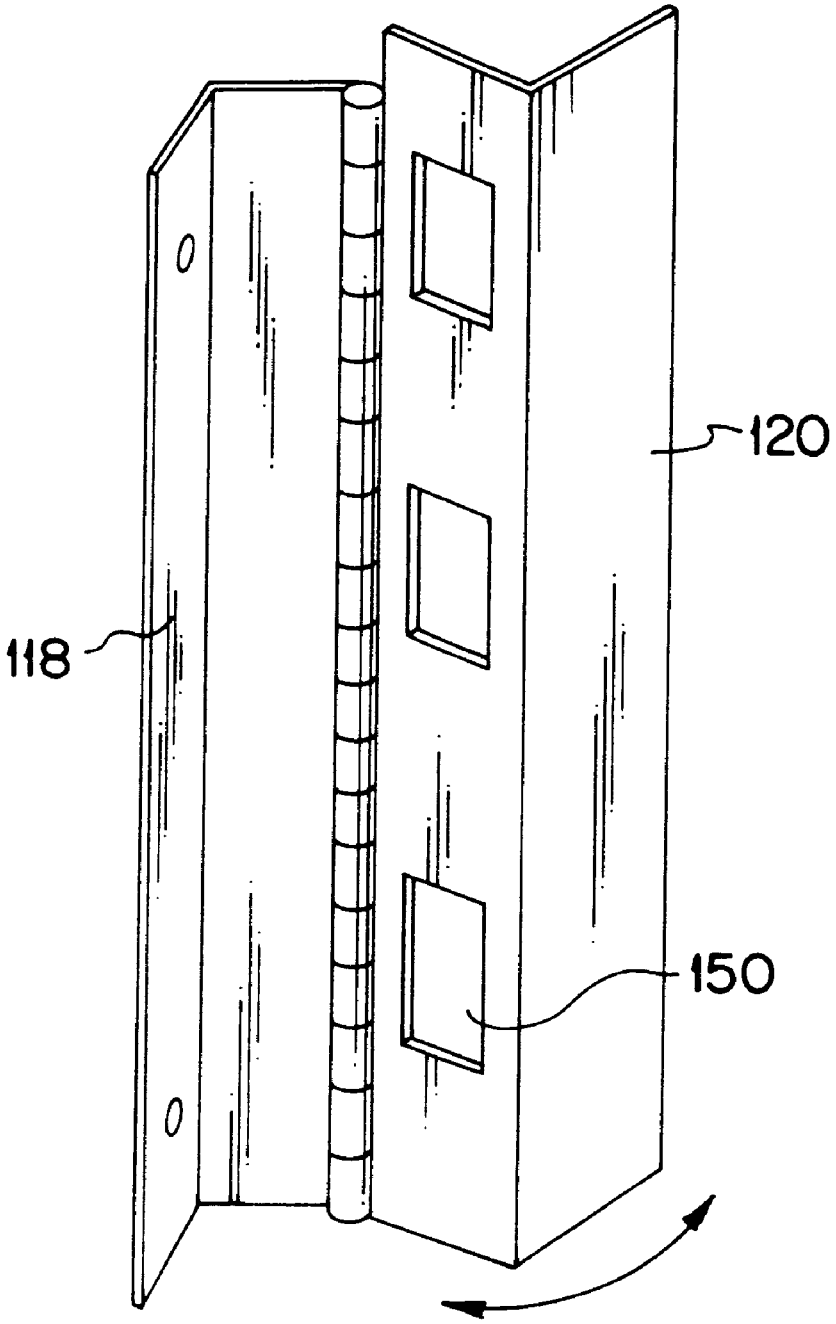
FIG. 12 illustrates a perspective view of the lock hinge of the present invention.

FIG. 8 illustrates an exploded view of portions of the lock system 100 of the present invention. A lock mechanism 108 acts to engage a retaining means 110 on the back portion of each of the drawers 112. In one embodiment, each of the lock mechanisms 108 is a lock hinge 114 riveted to a vertical angle 116, located on the back panel of the workstation (see FIG. 12 for a close-up erspective view of the lock hinges. It is prferred that the lock hinge 114 be comprised of a stationary leaf portion 118 and a moving leaf portion 120. In the preferred embodiment, the moving leaf portion 120 of the lock mechanism 108 rotates in the counterclockwise direction to unlock the drawers 112. (FIG. 9 illustrates a top plan view illustrating the lock mechanism 108 and drawer 112 interface details.) It is also preferred that the lock hinge 114 be spring loaded and possess a 90 degree stop angle. As illustrated in FIG. 9, the moving leaf portion 120 of the lock mechanism 108 will rotate approximately 45 degrees counterclockwise (looking down from the top) as the system activates from locked to unlocked position. The moving leaf 120 portion preferably has a series of rectangular slots 150. These rectangular slots 150 engage the retaining means 110 when the moving leaf portion 120 is in the locked position.

Although in FIG. 9, a horsehead retaining means is illustrated, it is appreciated that other retaining means may be used. For example, a hook latch retaining means may be used when the lock mechanism 108 contains hooks as opposed to engaging slots. It is also preferred that the lock mechanism 108 be vertically situated along the back of the unit so that the lock mechanism 108 can simultaneously lock and unlock all the drawers 112 of a bank of drawers.

The lock hinges 114 are activated by a transfer mechanism 122 that runs horizontally across the back of the workstation. In the preferred embodiment, the transfer mechanism 122 is a transfer channel 124. The transfer channel 124 is positioned behind a portion of each of the multiple banks of drawers. Rectangular slots 126 in the transfer channel 124 fit into tabs 128 at the top of the vertical angles 116 located on the back panel of the workstation. The tabs 128 guide the tranfer channel 124 as it moves left to right while preventing the channel 124 from rotating. It is preferred that plastic spacers 130 be screwed to a bottom flange of the transfer channel 124. These spacers 130 move the moving leaf portion 120 of the lock hinge 114 as the transfer channel 124 moves horizontally to the unlocked position (in an alternative embodiment they may also be configured to move the hinge to a locked position). In the embodiment illustrated in FIGS. 7–11, as the spacers 130 move to the right of the unit, they act to push the moving leaf portion 120 from the locked to the unlocked position. To lock the drawer, the transfer channel 124 is activated to return to the left position, wherein the spacers 130 also move to the left. The moving of the spacers 130 to the left allows the Proving leaf portion 120 of the spring-loaded lock hinge 114 to return to the locked position. It is appreciated that other components, other than spacers 130 may be used to activate the lock hinge 114.

Figure 13:
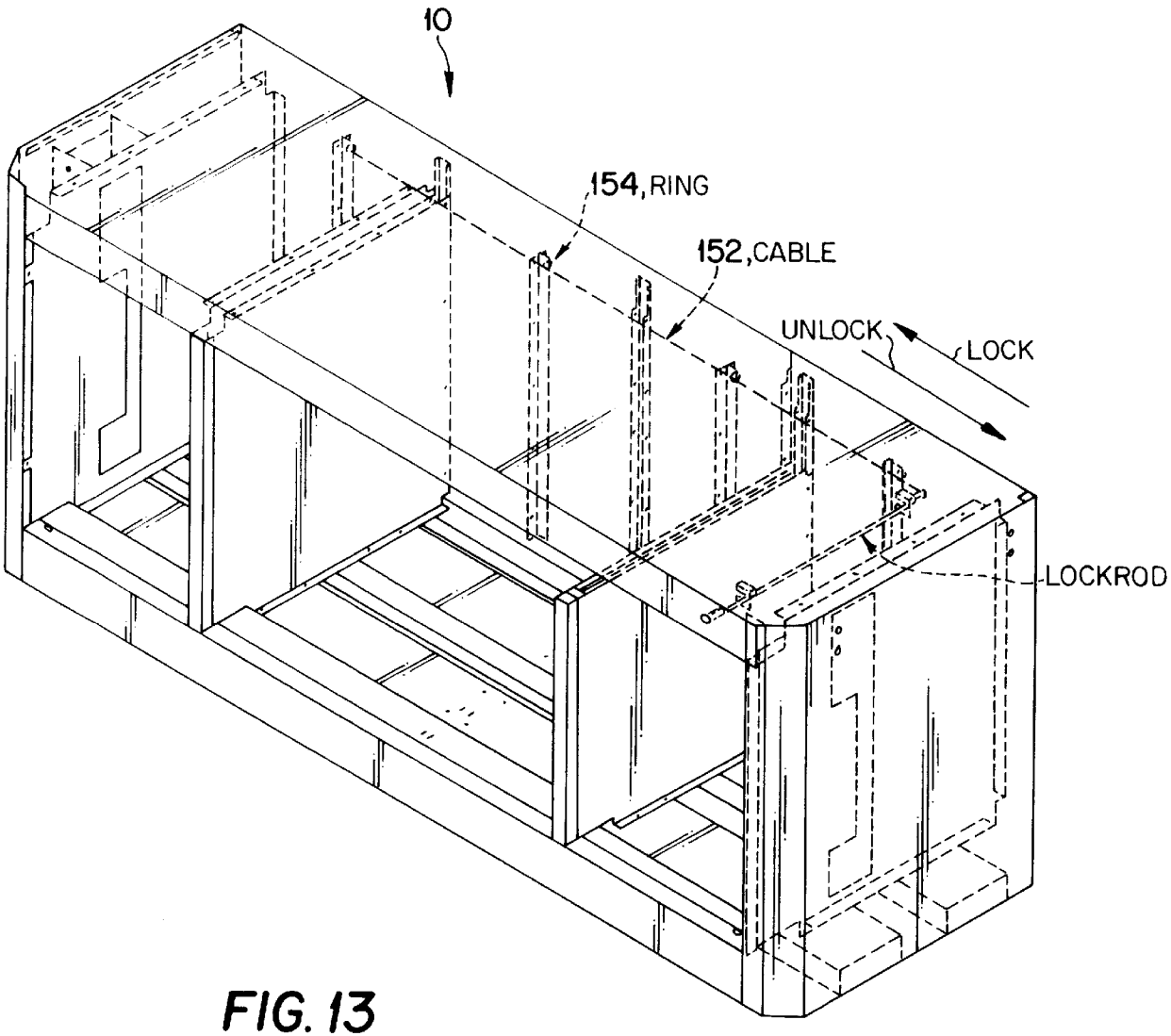
FIG. 13 illustrates an embodiment of the workstation having a cable as the transfer mechanism.

In another embodiment, illustrated in FIG. 13, the transfer mechanism is a cable 152. In one embodiment, the cable has loops or rings 154 that engage holes placed in the moving leaf portions 120 of the lock hinges 114. Horizontal movement of the cable 152 acts to move the moving leaf portion 120 from the locked to the unlocked position.

Figures 10, 11:
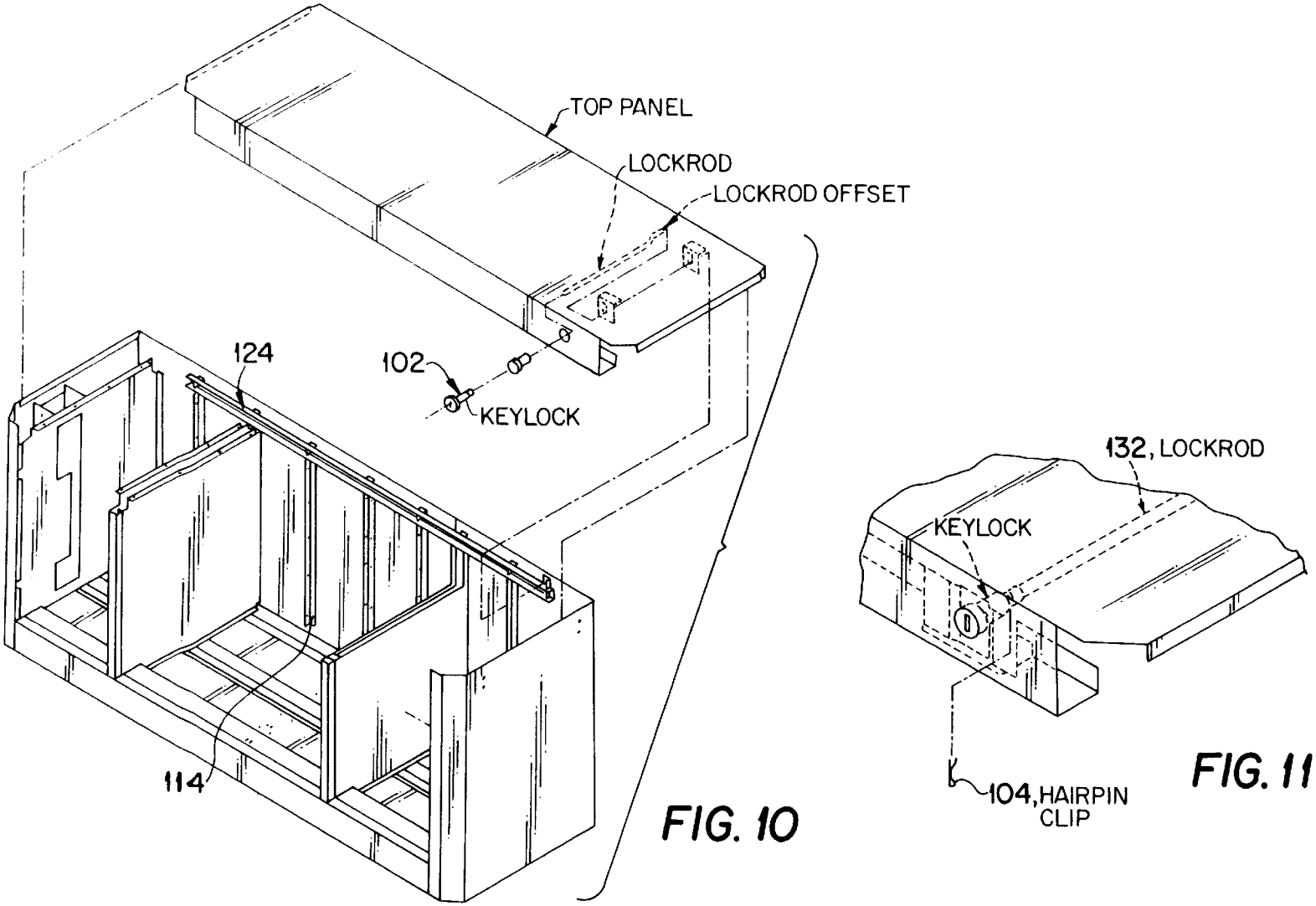
FIGS. 10–11 illustrate one embodiment of the key lock and lockrod of the present invention.

The transfer channel 124 is preferably activated to move in the horizontal direction via a lockrod system 132. FIG. 10 illustrates an exploded view of one embodiment of the lockrod system 132 of the present invention. FIG. 11 illustrates the preferred embodiment of the key lock 102 of the present invention. In the embodiment illustrated in FIGS. 10–11, an offset at the rear of the lockrod 132 rotates 180 degrees when activating the system. The offset in the lockrod 132 applies pressure to a bearing surface on the transfer channel 124. The transfer channel 124 displaces left to right the horizontal distance traveled by the 180 degrees rotation of offset in the lockrod 132 (approximately 0.54" in one embodiment, this 0.54" linear movement generates 45 degrees of rotation in the lock hinges 114). In the preferred embodiment, the lockrod 132 and the key lock 102 are connected by a hairpin clip 104. The hairpin clip 104 may be easily removed allowing the key lock 102 to be removed and replaced.

In a preferred embodiment, the lock system 100 of the present invention may be activated by remote entry. The remote entry module 106 is illustrated in FIG. 7. The remote entry module 106 is preferably a self-contained unit having a DC solenoid, receiver and battery back-up. The solenoid actuator connection to the transfer chamuel 124 is shown generally at 134. The remote entry module 106 preferably has a DC power line 136 that interfaces to an AC wall outlet 138 via a plug-in AC-DC power converter 140. The antenna 142 for the receiver may be routed through a knock-out portion 144 of the back panel, or across the inside panel, into the hat section space and through a hole in the base portion to the underside of the unit (see FIG. 7).

The remote entry module 106 may be mounted to the back panel of the unit via mounting holes provided in an upper portion of the inside of the back panel, top panel hat section and the transfer channel 124. It is also preferred that the back panel contain a "knock-out" portion which allows for easy access to the remote entry module 106 (the "knock-out" portion may be separately locked).

As described, the lock system 100 of the present invention provides an improved lock system that is manipulated by low torque, that is easily serviceable once installed, and which may be easily configured for different types of workstations, of differing size, and/or having different drawer arrangements. For example, the lock system 100 of the present invention may be easily configured for installation into workstations having the various drawer arrangements shown in FIGS. 5A–5Q, and FIG. 6. E.g., any of the different drawer arrangements shown in FIGS. 5A–5Q may be accommodated by installing a lockrod 132, a transfer channel 124, a lock hinge 114, and by placing vertical lock mechanisms 108 in predetermined locations on the back panel of the modular workstation corresponding to each bank of drawers, as described above.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. For example, the number and placement of the uprights may vary, the size of the modules may vary, and the base portion of the invention may be a one-piece construction as opposed to being modular. It is the intention, therefore, to limit the invention only as indicated by the scope of the claims.

What is claimed is:

1. A chest comprising:

a frame having a back wall;

a plurality of drawers mounted within said frame for movement between open and closed positions, said drawers being arranged in a vertical column, each of said drawers having a retainer extending rearwardly therefrom towards said back wall;

a locking system comprising:

a horizontally situated transfer structure movably mounted within said frame, said transfer structure being movable horizontally with respect to said frame;

an actuator carried on said frame separate from said drawers, said actuator being interconnected with said horizontally situated transfer structure such that only rotational movement of said actuator is transferred to said transfer structure via said interconnection to affect horizontal movement of said transfer structure; and a vertically situated lock mechanism having a frame mounting portion mounted to the back wall of said frame and a retainer engaging portion movable between (a) an engaged position wherein said retainer engaging portion engages the retainers on each of the drawers in said column to retain said drawers in the closed positions thereof and (g) a disengaged position wherein said retainer engaging portion is disengaged from said retainers on each of the drawers in said column to permit movement of said drawers to said open positions thereof;

said lock mechanism and said transfer structure being constructed and arranged such that horizontal movement of said transfer structure by operation of said actuator moves said retainer engaging portion between said engaged and disengaged positions there of, wherein said transfer structure is a flexible cable.

2. A chest comprising:

a frame having a back wall;

a plurality of drawers mounted within said frame for movement between open and closed positions, said drawers being arranged in a vertical column, each of said drawers having a retainer extending rearwardly therefrom towards said back wall;

a locking system comprising:

a horizontally situated transfer structure movably mounted within said frame, said transfer structure being movable horizontally with respect to said frame;

an actuator carried on said frame separate from said drawers, said actuator being interconnected with said horizontally situated transfer structure such that movement of said actuator is transferred to said transfer structure via said interconnection to affect horizontal movement of said transfer structure; and a vertically situated lock mechanism having a frame mounting portion mounted to the back wall of said frame and a retainer engaging portion movable between (a) an engaged position wherein said retainer engaging portion engages the retainers on each of the drawers in said column to retain said drawers in the closed positions thereof and (b) a disengaged position wherein said retainer engaging portion is disengaged from said retainers on each of the drawers in said column to permit movement of said drawers to said open positions thereof;

said lock mechanism and said transfer structure being constructed and arranged such that horizontal movement of said transfer structure by operation of said actuator moves said retainer engaging portion between said engaged and disengaged positions thereof, wherein said retainers are hooks extending rearwardly from said drawers, an d wherein each retainer engaging portion is formed from a single member and has a plurality of openings formed therethrough, said hooks being received within said openings when said retainer engaging portions are in said engaged positions there of to retain said drawers in said closed positions thereof.

3. A chest comprising:

a frame having a back wall;

a plurality of drawers mounted with in said frame for movement between open and closed positions, said drawers being arranged in a vertical column, each of said drawers having a retainer extending rearwardly therefrom towards said back wall;

a second plurality of drawers mounted within said frame for movement between open and closed positions, said second plurality of drawers being arranged in a second vertical column spaced horizontally from the aforesaid vertical column; each of said drawers of said second plurality having a retainer extending rearwardly therefrom;

a locking system comprising:

a horizontally situated transfer structure movably mounted within said frame, said transfer structure being movable horizontally with respect to said frame;

an actuator carried on said frame separate from said drawers, said actuator being interconnected with said horizontally situated transfer structure such that movement of said actuator is transferred to said transfer structure via said interconnection to affect horizontal movement of said transfer structure; and a vertically situated lock mechanism having a frame mounting portion mounted to the back wall of said frame and a retainer engaging portion movable between (a) an engaged position wherein said retainer engaging portion engages the retainers on each of the drawers in said column to retain said drawers in the closed positions thereof and (b) a disengaged position wherein said retainer engaging portion is disengaged from said retainers on each of the drawers in said column to permit movement of said drawers to said open positions thereof;

said lock mechanism and said transfer structure being constructed and arranged such that horizontal movement of said transfer structure by operation of said actuator moves said retainer engaging portion between said engaged and disengaged positions thereof, a second vertically situated lock mechanism having a frame mounting portion mounted to said back wall of said frame and a retainer engaging portion movable between (a) an engaged position wherein said retainer engaging portion of said second lock mechanism engages the retainers on each of the drawers in said second column to retain said drawers in said closed position thereof and (b) a disengaged position wherein said retainer engaging portion of said second lock mechanism is disengaged from the retainers on each of the drawers in said second column to permit movement of said drawers to said open position thereof;

said second lock mechanism and said transfer structure being constructed and arranged such that horizontal movement of said transfer structure by operation of said actuator moves the retainer engaging portions of both said lock mechanisms between the respective engaged and disengaged positions thereof, wherein said retainers are hooks extending rearwardly from said drawers, and wherein each retainer engaging portion is formed from a single member and has a plurality of openings formed therethrough, said hooks being received within said openings when said retainer engaging portions are in said engaged positions thereof to retain said drawers in said closed positions thereof.

* * * * *